United States Patent [19]

Wisler

[11] Patent Number: 4,645,417

[45] **Date of Patent: * Feb. 24, 1987**

[54] COMPRESSOR CASING RECESS

[75] Inventor: David C. Wisler, Fairfield, Ohio

[73] Assignee: General Electric Company, Cincinnati, Ohio

[ * ] Notice: The portion of the term of this patent subsequent to Aug. 19, 2003 has been disclaimed.

[21] Appl. No.: 577,398

[22] Filed: Feb. 6, 1984

[51] Int. Cl.[4] ..... F01D 11/08

[52] U.S. Cl. ..... 415/170 R; 415/DIG. 1

[58] Field of Search ..... 415/172 A, 181, 170 R, 415/DIG. 1, 199.5, 116

[56] References Cited

U.S. PATENT DOCUMENTS

| | | | |
|---|---|---|---|
| 1,568,034 | 12/1925 | Losel | 415/172 A |
| 3,885,886 | 5/1975 | Richter | 415/116 |
| 3,989,406 | 11/1976 | Bliss | 415/1 |
| 4,238,170 | 12/1980 | Robideau et al. | 415/172 A |

FOREIGN PATENT DOCUMENTS

| | | | |
|---|---|---|---|
| 0074649 | 7/1914 | Austria | 415/172 A |
| 10179 | of 1912 | United Kingdom | 415/172 A |
| 414681 | 6/1966 | Switzerland. | |

*Primary Examiner*—Edward K. Look
*Assistant Examiner*—H. Edward Li
*Attorney, Agent, or Firm*—Douglas S. Foote; Derek P. Lawrence

[57] ABSTRACT

A means for improving the aerodynamic efficiency of the compressor of an axial flow turbomachine is disclosed. The compressor includes an airfoil relatively rotatable with respect to a radially disposed surface which bounds a flowpath for aft moving fluid. The surface has a circumferentially extending recess radially disposed relative to the airfoil. The recess has a generally aft facing wall and a generally forward facing wall. The aft facing wall is oriented so as to provide a barrier to the forward flow of fluid in the clearance between airfoil and surface. The forward facing wall is oriented so as to provide an aerodynamically smooth transition from the recess into the flowpath.

8 Claims, 5 Drawing Figures

COMPRESSOR CASING RECESS

This invention relates generally to gas turbine engines and, more particularly, to means for reducing compressor blade tip clearance losses.

CROSS-REFERENCE TO RELATED APPLICATION

The invention disclosed and claimed herein is related to the invention disclosed and claimed in patent application Ser. No. 577,397, filed simultaneously herewith.

BACKGROUND OF THE INVENTION

As a result of increasing fuel prices during the 1970's, aircraft engine designers have sought to improve the efficiency of their product. One area of the gas turbine engine which has been studied is the compressor. Basically, the compressor consists of a number of bladed compressor disks which rotate at high speed and increase the pressure of an air stream flowing through the compressor. The high pressure air exiting the compressor is mixed with fuel and burned in a combustor. The exhaust gases are then expanded through a turbine wheel where work is extracted from the flow stream.

The airflow through the compressor can be divided into two broad regions—the endwall flow region near both the casing and the hub where viscous boundar layer effects and blade/vane tip effects dominate and the center-flow region in the central portion of the compressor where the aforementioned effects are small or negligible. Roughly 50% of all compressor loss occurs in the endwall region.

One condition which contributes to this loss, thereby reducing compressor efficiency, is caused by the gap that normally is between the end of a compressor blade and the surrounding casing in the endwall region. Air which is compressed by the rotating blade has a tendency to backflow, or leak, over the rotor tip through this gap resulting in a tip clearance vortex. This vortex interacts with the casing wall boundary layer and produces tip loss.

The typical approach for controlling this leakage has been to minimize the clearance between the rotor tip and the surrounding casing. However, both the compressor casing and the compressor blade grow radially during periods of engine operation. In order to avoid contact between the blades and the casing, sufficient clearance must be left during normal engine operation to allow for differential growth during transient operating conditions. An alternative approach is to anticipate rubs by providing either an abradable strip in the casing or an abradable tip on the rotor blade to permit some degree of a controlled rub.

Another technique for reducing leakage across blade tips has been to form a recess in the wall of the casing and to extend the rotor blade to be nearly line-on-line with the original casing wall. Such recesses may accept the rotor blade tip during some or all periods of engine operation. The transition region from compressor casing to recess is typically characterized by an abrupt change from the smooth casing wall. These abrupt transition regions occur both in the forward and aft ends of the recess. For example, trenches with rectangular cross section are known wherein the transition regions are formed by right angles. Test results indicate that such trenches may provide, at best, a marginal improvement in efficiency and, under certain conditions, actually degrade performance.

OBJECTS OF THE INVENTION

It is an object of the present invention to provide a new and improved compressor casing recess.

It is a further object of the present invention to provide a new and improved compressor casing recess which reduces compressor rotor tip losses.

Another object of the present invention is to provide a new and improved means for improving the aerodynamic efficiency of the compressor of a gas turbine engine.

SUMMARY OF THE INVENTION

The present invention is an improvement for a compressor of an axial flow turbomachine having an airfoil relatively rotatable with respect to a radially disposed surface. The surface bounds a flowpath for aft moving fluid. The improvement comprises a circumferentially extending recess in the surface, radially disposed relative to the airfoil with a clearance therebetween. The recess includes a generally aft facing wall and a generally forward facing wall. The aft facing wall is oriented so as to provide a barrier to the forward flow of fluid in the clearance. The forward facing wall is oriented so as to provide an aerodynamically smooth transition from the recess into the flowpath.

In a particular form of the invention, the aft facing wall of the recess is substantially normal to the surface. The forward facing wall forms an angle of less than 10° with respect to the casing surface.

DETAILED DESCRIPTION OF THE INVENTION

This invention may be used in the compressor of any axial flow turbomachine. For means of illustration, the invention will be described for a gas turbine engine.

Figure 1:
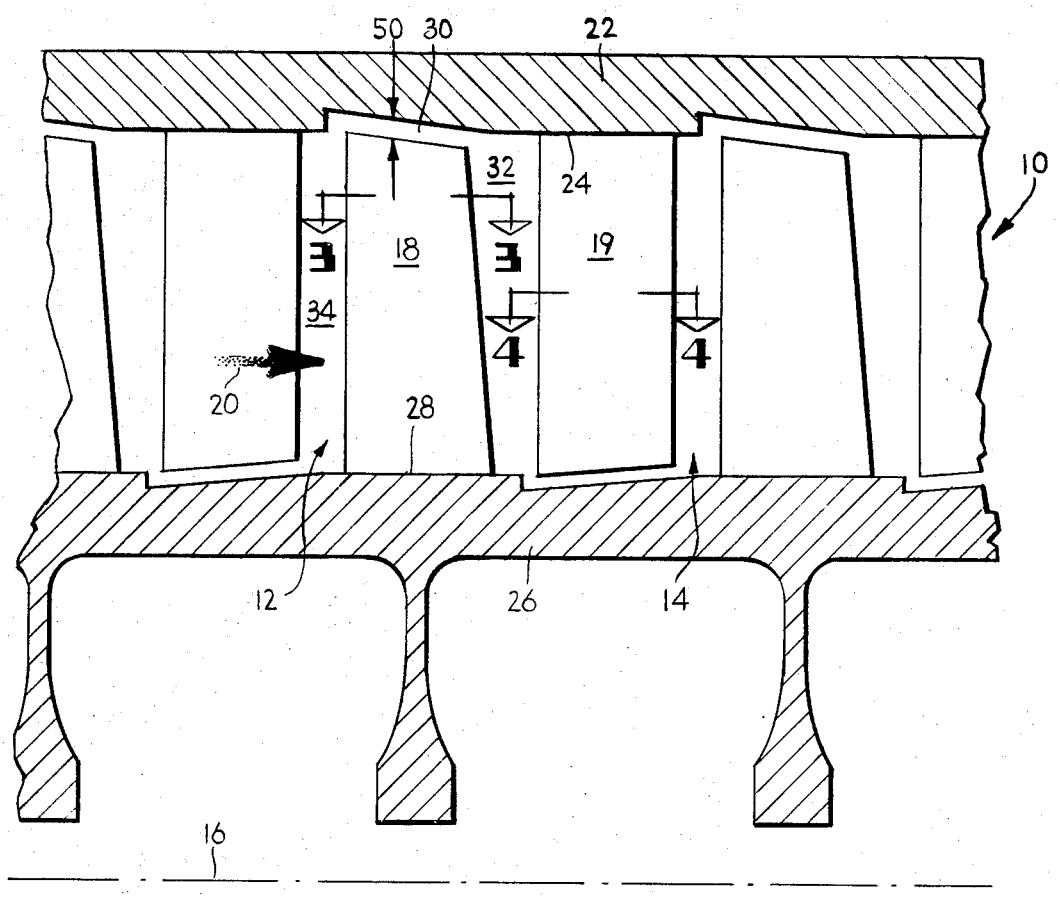
FIG. 1 is a view of a portion of a compressor of a gas turbine engine according to one form of the present invention.

A portion of a compressor section 10 of a gas turbine engine having a rotor row 12 and stator row 14 is shown in FIG. 1. Rotor row 12 has a plurality of airfoils or blades 18 which are rotatable about engine center line 16. Stator row 14 has a plurality of airfoils or vanes 19 fixed with respect to center line 16. A flowpath 20 for the movement of air extends axially through the compression section. The flowpath is bounded by an outer casing 22 with radially inward facing surface 24 and inner wall 26 with radially outward facing surface 28. Each rotor blade 18 has a radially outer end or blade tip 30. Outer casing 22 circumferentially surrounds each rotor row 12. A clearance 50 must be maintained between the rotating blade tip 30 and the stationary outer casing 22 in order to prevent rubbing therebetween.

It should be clear that each blade 18 is relatively rotatable with respect to radially disposed surface 24 just as vane 19 is relatively rotatable with respect to radially disposed surface 28. Further, vane 19 is fixed with respect to surface 24 and blade 18 is fixed with respect to surface 28.

As blades 18 rotate about center line 16, air in flowpath 20 is moved in a generally aft direction. At the same time, air is compressed as it passes each rotor row 12 thereby increasing its pressure. Consequently, a higher pressure region 32 aft of rotor row 12 relative to a lower pressure region 34 forward of row 12 is defined. As shown in FIG. 3, each blade 18 rotating in the direction indicated by arrow 52 has a pressure surface 54 and a suction surface 56. The pressure on surface 54 is higher than that on surface 56. The tendency of higher pressure air to move through the clearance 50, shown in FIG. 2, to the region of lower pressure, as shown by arrow 58 in FIG. 3, contributes to losses in the form of a tip clearance vortex formed near the radially outer end of tip 30 of blade 18.

Contributing to the loss problem is the fact that boundary layer air near the radially inward facing surface 24 is moving generally in the aft direction and interacts with the air tending to flow forward through tip clearance 50. It is believed that the present invention inhibits the forward motion of the tip clearance flow while allowing an unobstructed passage of the aft moving main flow.

Figure 2:
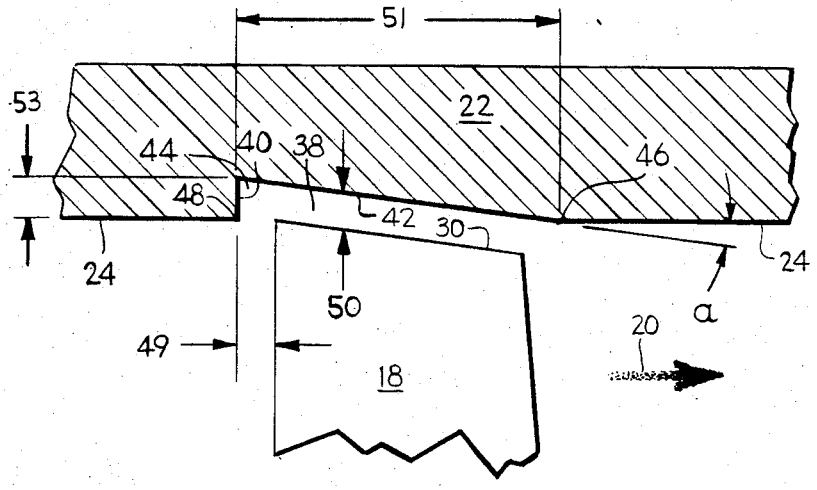
FIG. 2 is a more detailed view of a compressor rotor blade and adjacent casing as shown in FIG. 1.
Figure 3:
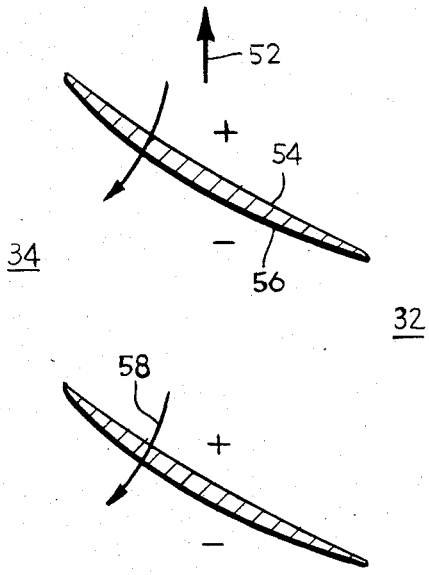
FIG. 3 is a view taken along the line 3—3 in FIG. 1.

FIG. 2 shows a rotor blade 18 and outer casing 22 according to one form of the present invention. Disposed in outer casing 22 is a recess 38 which circumferentially surrounds blade tip 30. Recess 38 is defined by first and second intersecting walls 40 and 42, respectively. In the embodiment shown, wall 40 is generally aft facing and substantially normal to inward facing surface 24. Second wall 42 is generally forward facing and defines a smooth curve between the intersection 44 with first wall 40 and intersection 46 with surface 24.

The configuration shown in FIG. 2 is intended to create an abrupt change from casing surface 24 to first wall 40 at their intersection 48, and a non-abrupt or relatively smooth transition from second wall 42 to casing surface 24 at intersection 46. It is believed that the abrupt transition at intersection 48 provides good separation of the aft flowing boundary layer air from surface 24 while at the same time providing a barrier in the form of wall 40 to minimize the forward flow from the tip clearance vortex. It is further believed that the non-abrupt transition from second wall 42 to surface 24 at intersection 46 allows for an aerodynamically smooth transition or flow of air flowing from recess 38 into flowpath 20.

It will now occur to those skilled in the art that a variety of configurations of recess 38 are possible to satisfy these conditions. For example, second wall 42 may define a variety of relatively smooth curves which form a non-abrupt transition into surface 24 at intersection 46. In the embodiment shown in FIG. 2, wall 42 defines a curve which is substantially a straight line forming an angle of intersection alpha with respect to casing surface 24. In a preferred embodiment, angle alpha will be generally less than or equal to 10°. However, angle alpha will depend upon the length 51 of recess 38 as measured from intersection 48 to intersection 46, the depth 53 of recess 38, and the geometric shape of wall 42.

Blade tip 30 may be contoured to be geometrically similar to the curve defined by second wall 42. For example, in the embodiment of FIG. 2, tip 30 defines a straight line substantially parallel to wall 42. Thus, each point on this contour is substantially the same radial distance to wall 42.

It should be understood that the radial and axial location of blade tip 30 relative to recess 38 will change during engine operation as blade 18 deflects, elastically deforms due to centrifugal force, or experiences differential thermal growth with respect to casing 22. FIG. 2 shows a preferred embodiment wherein blade tip 30 is located to recess 38 during steady state operation. The critical dimensions at this operating condition are the axial distance 49 between blade 18 and first wall 40 and the radial distance or tip clearance 50 between tip 30 and second wall 42. Distance 49 will depend on several factors including blade material and geometry. In a preferred embodiment, distance 49 is on the order of 10% of the blade circumferential spacing. Distance 50 is also a function of blade material and geometry. In general, this distance is designed to allow for differential growth during periods of engine transient operation. According to a preferred embodiment, this distance will be approximately 0.10% of the diameter of rotor row 12.

It will be clear to those skilled in the art that the distances 49 and 50 may be varied according to the particular application without departing from the scope of the present invention. It is further within the scope of the present invention to use an abradable liner for walls 42 or 40 of recess 38 and/or an abradable tip on blade 18. In either of these cases, distances 50 and/or 49 may be varied as is known in the art.

Figure 5:
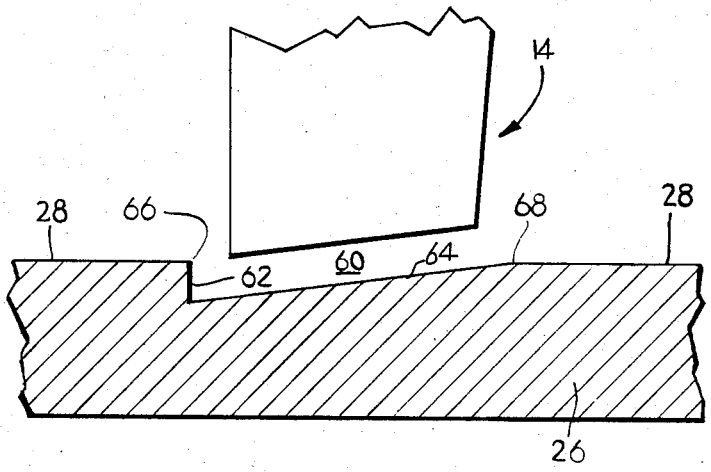
FIG. 5 is a more detailed view of a compressor stator vane and adjacent inner wall as shown in FIG. 1.

According to another form of the present invention, shown in FIGS. 1 and 5, a recess 60 is disposed in radially outward facing surface 28 of inner wall 26 and displaced radially relative to stator row 14. As with casing recess 38, recess 60 is defined by first and second intersecting walls 62 and 64. Wall 62 is generally aft facing and forms an abrupt change from surface 28 at their intersection 66. Wall 64 is generally forward facing and forms a relatively non-abrupt change from surface 28 at their intersection 68.

Figure 4:
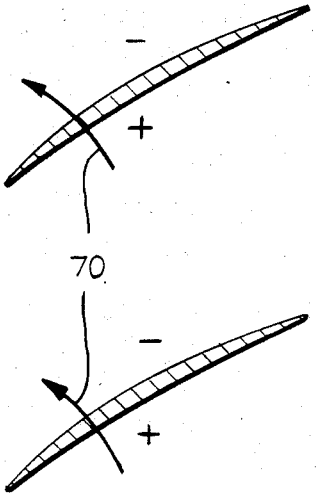
FIG. 4 is a view taken along the line 4—4 in FIG. 1.

Although stator row 14 does not move, its relationship to inner wall 26 is similar to the relationship between rotor row 12 and outer casing 22. Each has a row of airfoils relatively rotatable with respect to a radially disposed surface. Further, air passing aftward through each row experiences a pressure rise. As a result, air tends to move forward across the airfoil tip from a region of higher pressure to a region of lower pressure. FIG. 4 shows such air movement by arrow 70.

The alternative embodiments for configurations of recess 38 as described above apply equally to recess 60. It will be clear that compressors may be designed with recesses 38 only in the outer casing 22, with recesses 60 only in the inner wall 26, or with recesses in both casing 22 and wall 26 with either the same or different configurations.

It will be clear to those skilled in the art that the present invention is not limited to the specific embodiments described and illustrated herein. Nor is the invention limited to compressor casing recesses or inner wall recesses with the particular straight line configuration as shown herein. Rather, any geometric configuration of an aft facing wall which inhibits forward flow from the tip clearance vortex and allows good separation of the boundary layer air, and any geometric configuration of a forward facing wall or walls which provides a smooth transition into flowpath 20 is within the scope of the present invention.

It will be understood that the dimensions and proportional and structural relationships shown in the drawings are illustrated by way of example only and those illustrations are not to be taken as the actual dimensions or proportional structural relationships used in the compressor casing recess of the present invention.

It should be understood that the compressor section portion 10, shown in FIG. 1, is intended to illustrate the relationship between a relatively rotatable airfoil and radially disposed surface, and the recess in such surface. The flowpath 20, and the flowpath surfaces of the outer casing and the inner wall are aligned axially with engine center line 16. However, in many applications, these surfaces and flowpaths may be sloped with respect to the engine center line. Thus, terms such as "axial" and "axially directed" as used herein define a direction substantially parallel to any one of the following: the engine center line, the flowpath, or a flowpath surface.

Numerous modifications, variations, and full and partial equivalents can be undertaken without departing from the invention as limited only by the spirit and scope of the appended claims.

What is desired to be secured by Letters Patent of the United States is as follows.

What is claimed is:

1. In a compressor of an axial flow turbomachine having an airfoil relatively rotatable with respect to a radially disposed surface, said airfoil being shroudless at its radially outer end, said surface bounding a flowpath for aft moving fluid, the improvement comprising:

a circumferentially extending recess in said surface, radially disposed relative to said airfoil with a clearance therebetween;

wherein said recess includes a generally aft facing wall and a generally forward facing wall, said aft facing wall being oriented so as to provide a barrier to the forward flow of said fluid in said clearance, and said forward facing wall being oriented so as to provide an aerodynamically smooth transition from said recess into said flowpath.

2. In a compressor of an axial flow turbomachine having an airfoil relatively rotatable with respect to a radially disposed surface, said surface bounding a flowpath for aft moving fluid, the improvement comprising:

a circumferentially extending recess in said surface, radially disposed relative to said airfoil;

wherein said recess includes a generally aft facing wall and a generally forward facing wall, said aft facing wall being substantially normal to said surface and said forward facing wall forming an angle of generally less than 10° with respect to said surface.

3. In a gas turbine engine having a rotatable compressor blade and an annular casing, said blade being shroudless at its radially outer end, said casing bounding a flowpath for aft moving air, said casing circumferentially surrounding said blade, and having a radially inward facing surface, the improvement comprising:

a circumferentially extending recess in said surface, radially disposed relative to said blade with a clearance therebetween, said recess including a generally aft facing wall and a generally forward facing wall;

wherein said aft facing wall is oriented so as to provide a barrier to the forward flow of said air in said clearance, and said forward facing wall is oriented so as to provide an aerodynamically smooth transition from said recess into said flowpath.

4. In a gas turbine engine having a rotatable compressor blade and an annular casing circumferentially surrounding said blade, said casing having a radially inward facing surface, the improvement comprising:

a circumferentially extending recess in said surface, said recess having a generally aft facing wall and a generally forward facing wall, said aft facing wall being substantially normal to said casing surface and said forward facing wall forming an angle of generally less than 10° with respect to said casing surface.

5. In a gas turbine engine including a bladed rotor disk for moving an air stream in a generally aft direction, said rotor disk having a plurality of blades with each blade having a radially outer end, and an annular casing circumferentially surrounding said disk with a radially inward facing surface bounding a flowpath, the improvement comprising:

a circumferential recess disposed in said surface, said recess being defined solely by first and second intersecting walls with said first wall being substantially normal to said casing surface and aft facing.

6. The invention, as recited in claim 5, wherein said second wall is oriented so as to provide an aerodynamically smooth transition from said recess into said flowpath.

7. The invention, as recited in claim 6, wherein said second wall defines a substantially straight line forming an angle of intersection with respect to said casing surface of generally less than 10°.

8. The invention, as recited in claim 5, further comprising:

a contoured tip on said radially outer and of each of said blades, said contour being geometrically similar to said recess so that the radial distance from each point on said contour to said second wall is substantially the same.

* * * * *

UNITED STATES PATENT AND TRADEMARK OFFICE

CERTIFICATE OF CORRECTION

PATENT NO. : 4,645,417

DATED : February 24, 1987

INVENTOR(S) : David C. Wisler

It is certified that error appears in the above—identified patent and that said Letters Patent is hereby corrected as shown below:

Column 6, claim 8, line 49, change "and" to "end".

Signed and Sealed this

Twenty-fourth Day of November, 1987

*Attest:*

DONALD J. QUIGG

*Attesting Officer*

*Commissioner of Patents and Trademarks*